US010738523B2

(12) United States Patent
Wang

(10) Patent No.: US 10,738,523 B2
(45) Date of Patent: Aug. 11, 2020

(54) BIDIRECTIONAL DAMPER AND MOVABLE DOOR THEREOF

(71) Applicant: Shengli Wang, Shenzhen (CN)

(72) Inventor: Shengli Wang, Shenzhen (CN)

( * ) Notice: Subject to any disclaimer, the term of this patent is extended or adjusted under 35 U.S.C. 154(b) by 150 days.

(21) Appl. No.: 16/069,889

(22) PCT Filed: Jun. 2, 2016

(86) PCT No.: PCT/CN2016/084432

§ 371 (c)(1),
(2) Date: Jul. 13, 2018

(87) PCT Pub. No.: WO2017/124679

PCT Pub. Date: Jul. 27, 2017

(65) Prior Publication Data

US 2019/0024429 A1 Jan. 24, 2019

(30) Foreign Application Priority Data

Jan. 18, 2016 (CN) ..... 2016 1 0032954

(51) Int. Cl.

| | |
|---|---|
| ***E05F 5/08*** | (2006.01) |
| ***E05F 5/10*** | (2006.01) |
| ***E05F 1/16*** | (2006.01) |
| ***E05F 3/18*** | (2006.01) |
| ***E05F 5/00*** | (2017.01) |

(52) U.S. Cl.

CPC ..... *E05F 5/08* (2013.01); *E05F 1/16* (2013.01); *E05F 3/18* (2013.01); *E05F 5/003* (2013.01); *E05F 5/10* (2013.01); *E05Y 2201/686* (2013.01); *E05Y 2800/24* (2013.01); *E05Y 2900/132* (2013.01)

(58) Field of Classification Search

CPC ..... E05F 5/003; E05F 3/00; E05F 3/18; E05F 1/16; E05F 5/10

See application file for complete search history.

(56) References Cited

U.S. PATENT DOCUMENTS

| | | | | |
|---|---|---|---|---|
| 8,402,606 | B1 * | 3/2013 | Tsai | E05F 3/18 16/49 |
| 8,443,551 | B2 * | 5/2013 | Walhorn | E05F 1/16 16/71 |
| 8,561,352 | B2 * | 10/2013 | Vogler | E05F 5/003 49/409 |
| 8,793,839 | B2 * | 8/2014 | Iwaki | E05F 5/003 16/72 |

(Continued)

*Primary Examiner* — Justin B Rephann

(57) ABSTRACT

A bidirectional damper includes a box body, a damping cylinder arranged in the box body, a spring assembly, and two sliding blocks. The damping cylinder and the spring assembly are parallelly arranged between two sliding blocks, and ends of the damping cylinder and the spring assembly pivots with corresponding sliding block. Sliding pins are arranged on sides of the two sliding blocks, and a first blocking portion and a second blocking portion are arranged on lower ends of the two sliding blocks. Sliding grooves are arranged on sides of the box body and extends along two ends of the box body, and the sliding grooves are correspondingly matched with the sliding pins on the two sliding blocks. An end of the sliding grooves, near an end of the box body, is bent towards a top of the box body.

4 Claims, 7 Drawing Sheets

(56) References Cited

U.S. PATENT DOCUMENTS

| | | | | |
|---|---|---|---|---|
| 8,931,138 | B2 * | 1/2015 | Shimizu | E05F 1/16 16/72 |
| 9,388,622 | B1 * | 7/2016 | Paron | E05F 15/56 |
| 2011/0023370 | A1 * | 2/2011 | Zimmer | E05F 5/003 49/360 |
| 2011/0067313 | A1 * | 3/2011 | Walhorn | E05F 1/16 49/360 |
| 2013/0019438 | A1 * | 1/2013 | Tanno | E05F 1/16 16/94 R |
| 2013/0219657 | A1 * | 8/2013 | Iwaki | E05F 3/00 16/64 |
| 2015/0026928 | A1 * | 1/2015 | Haab | E05D 15/0652 16/96 R |
| 2017/0051548 | A1 * | 2/2017 | Wang | E05F 5/02 |
| 2018/0216383 | A1 * | 8/2018 | Molloy | E05F 3/227 |

* cited by examiner

BIDIRECTIONAL DAMPER AND MOVABLE DOOR THEREOF

BACKGROUND OF INVENTION

1. Field of Invention

The present disclosure relates to the field of damper technology, and more particularly to a bidirectional damper and a movable door thereof.

2. Description of Prior Art

In conventional movable doors, a damper locator often is arranged on two ends of a guide rail or a door body. When the movable door is pushed to two sides of the movable door, a hook or collision block of the movable door is matched with a unidirectional damper to form a damping buffer. Therefore, two damper locators need to be respectively arranged on the two sides of the movable door, which is complex in installation. Size is large and cost is high.

SUMMARY OF INVENTION

In view of the above problem, the aim of the present disclosure is to provide a bidirectional damper and a movable door thereof capable of having the bidirectional damper to form damping buffer and location for top of the movable door. Specific scheme is shown as follow:

A bidirectional damper comprises: a box body, two damping cylinders arranged in the box body, a spring assembly, and two sliding blocks. The damping cylinders and the spring assembly are arranged between two sliding blocks in parallel, and ends of the damping cylinders and the spring assembly pivots with a corresponding sliding block. Sliding pins are arranged on sides of the two sliding blocks, and a first blocking portion and a second blocking portion are arranged on lower ends of the two sliding blocks. Sliding grooves are arranged on sides of the box body and extends along two ends of the box body, and the sliding grooves are matched with the sliding pins on the two sliding blocks. An end of the sliding grooves, near an end of the box body, is bent towards a top of the box body. A sliding opening is arranged on a bottom of the box body. The first blocking portion and the second blocking portion on lower ends of the two sliding blocks extend out the box body from the sliding opening of the box body.

Furthermore, the bidirectional damper comprises a damping box and a connection block. The spring assembly comprises a first spring and a second spring, and two ends of the damping cylinders and the first spring are connected with the damping box and the connection block, respectively. Pivots are arranged on the ends of the damping box and ends of the connection block, and pivot holes are arranged on the two sliding blocks and are matched with the pivots. The damping cylinders are connected with the first spring by the pivots of the damping cylinders and the connection block and the pivot holes of the two sliding blocks. Two ends of the second spring are connected with the two sliding blocks.

Furthermore, containing grooves for containing the damping cylinders and the first spring are arranged on the damping box; the damping cylinders and the first spring are located in the containing grooves; the second spring is arranged on the side of the damping box, and the second spring and the damping box are arranged in parallel.

Furthermore, the ends of the damping cylinders and the first spring are connected with a connection block; two ends of the second are connected with the two sliding blocks.

Furthermore, the bidirectional damper comprises an inner sleeve and an inner sleeve shell, the box body is arranged in the inner sleeve; and an opening, corresponding to the sliding opening of the box body is arranged on a bottom of the box body; rollers are arranged on two ends of the bottom of the inner sleeve. A top of the inner sleeve is fixed on the inner sleeve shell.

A movable door comprises a door body. The bidirectional damper and two collision blocks corresponding to the two sliding blocks are arranged on a top or a bottom of the door body. When the door body moves, the two collision blocks impact a first blocking portion or a second blocking portion.

Furthermore, the movable door comprises a track corresponding to the bidirectional damper. The two collision blocks are arranged in the track, and the movable door move along the track.

Furthermore, flanges are arranged on an inner side of the track and extension parts are arranged on the two sides of bottoms of the two collision blocks. The extension parts are located below the flanges in the track. Through screw holes are arranged in tops of the two collision blocks, and screws matched with the through screw holes are abutted against the bottom of the track. The screws enable the two collision blocks to rise to the extension parts to be clamped on the flanges.

The bidirectional damper can achieve bidirectional damping buffer and location. The bidirectional damper can be arranged on the bottom of the movable door or top of the movable door, so that structure is simple, installation is convenience and cost is low.

DETAILED DESCRIPTION OF PREFERRED EMBODIMENTS

In order to more fully understand the technical content of the present disclosure, the present disclosure is further described in detail in accordance with the figures and the exemplary examples.

Embodiment 1

Figure 1:
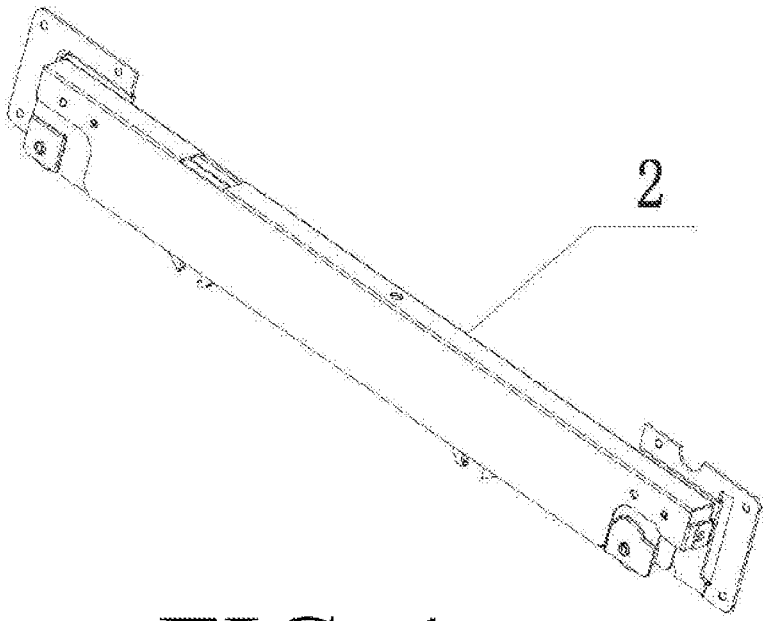
FIG. 1 is a structural diagram of a bidirectional damper of an embodiment of the present disclosure.
Figure 2:
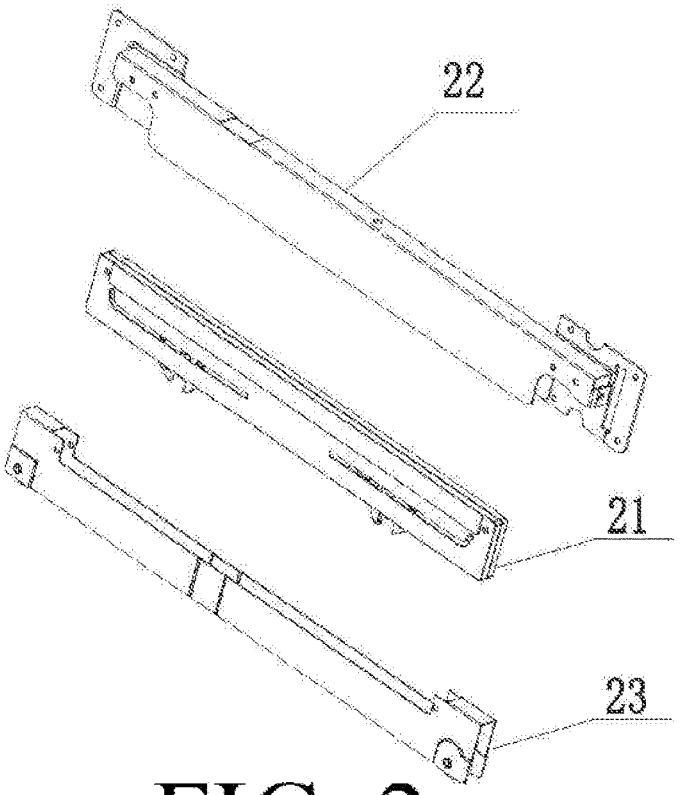
FIG. 2 is an exploded diagram of the bidirectional damper of the embodiment of the present disclosure.
Figure 3:
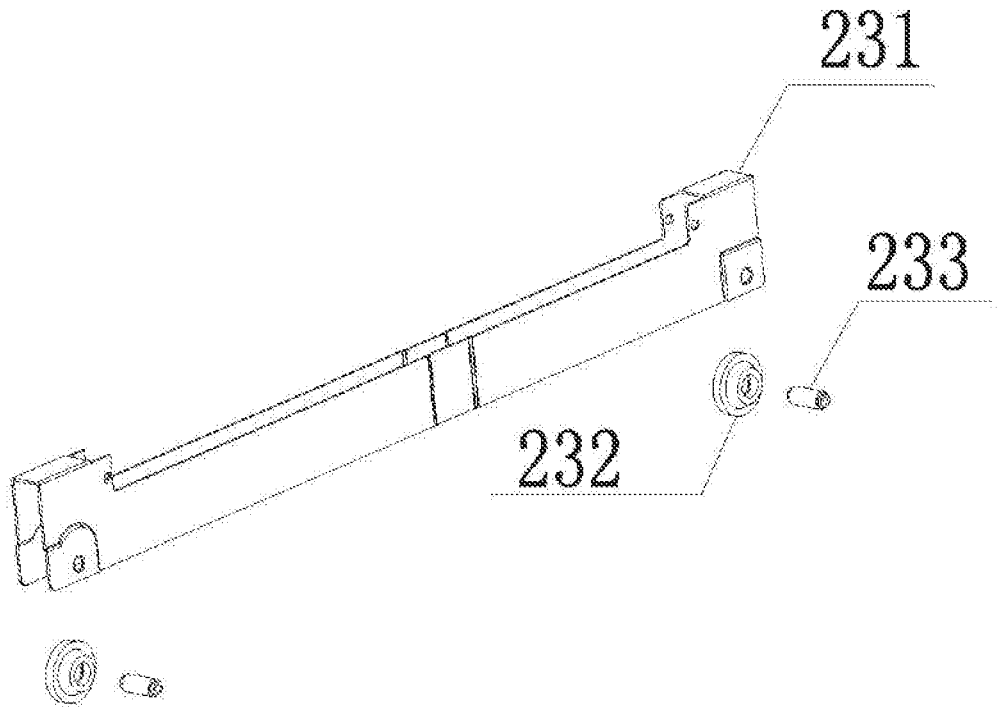
FIG. 3 is exploded diagram of an inner sleeve of the embodiment of the present disclosure.
Figure 4:
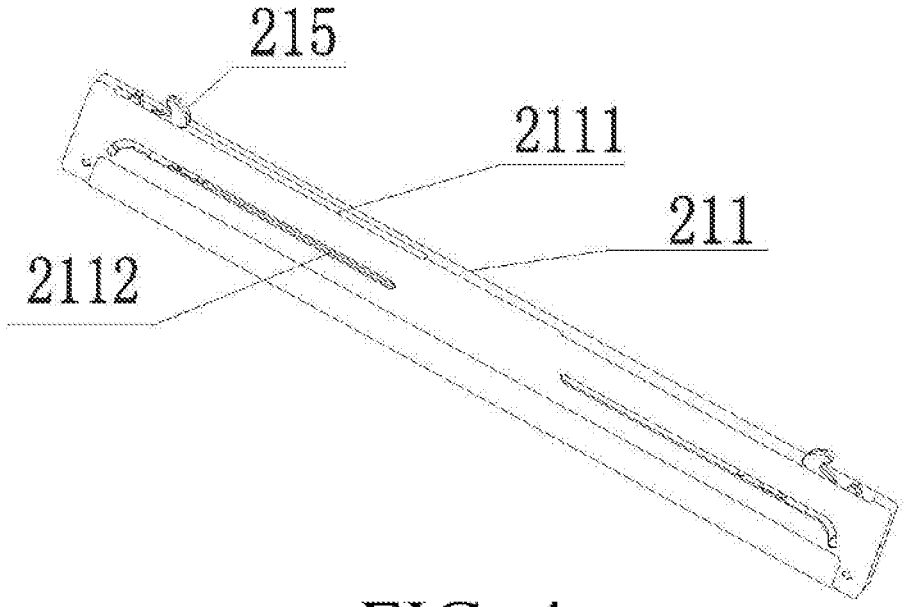
FIG. 4 is a structural diagram of a bidirectional damping of the embodiment of the present disclosure.
Figure 5:
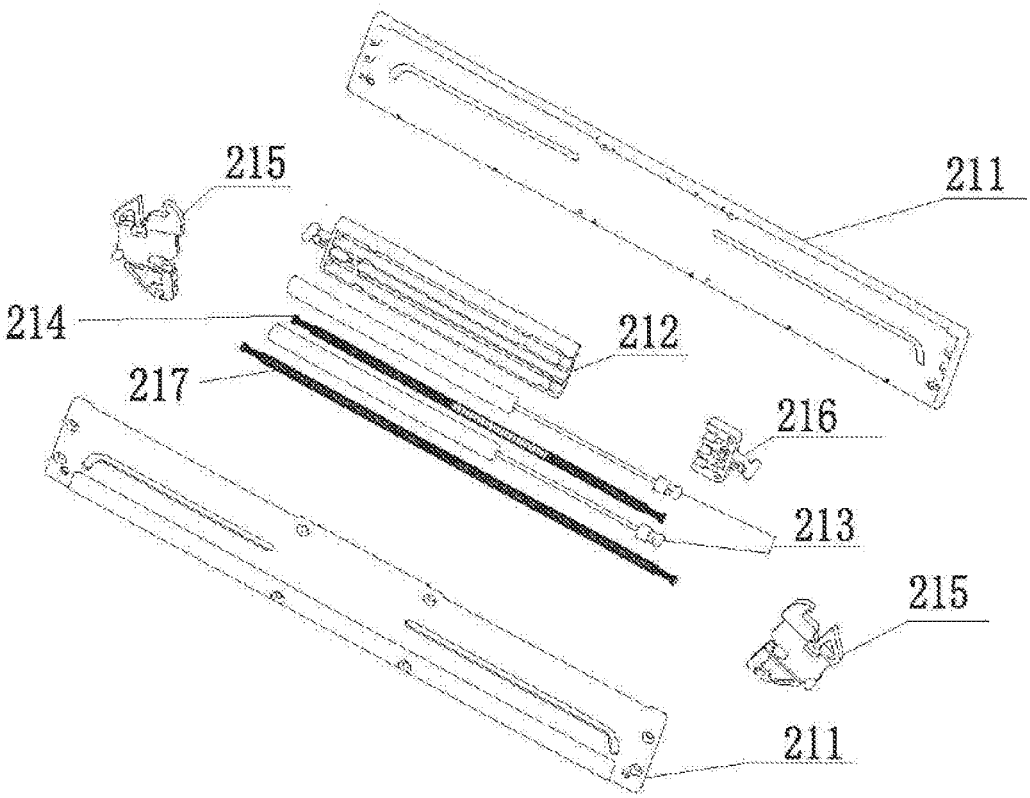
FIG. 5 is an exploded diagram of a bidirectional damping of the embodiment of the present disclosure.
Figure 6:
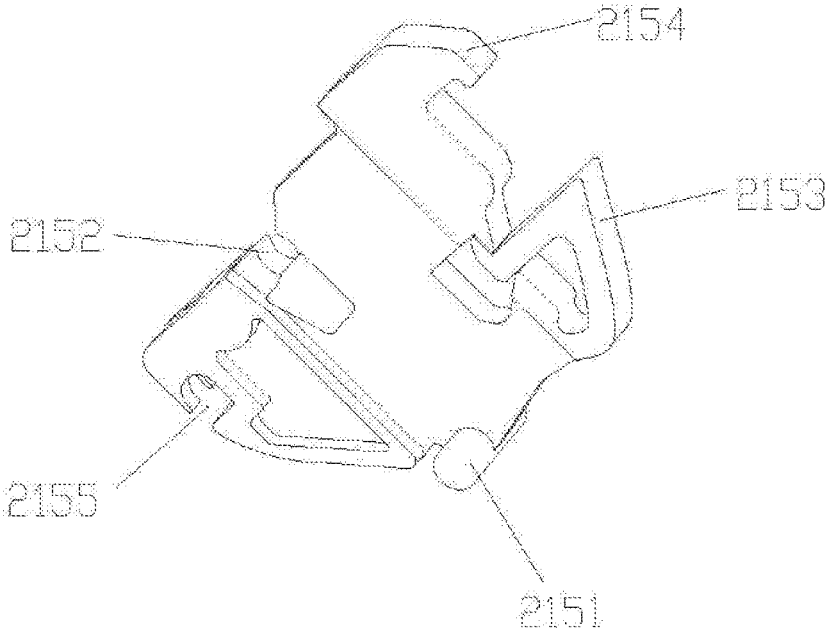
FIG. 6 is a structural diagram of a sliding block of the embodiment of the present disclosure.
Figure 7:
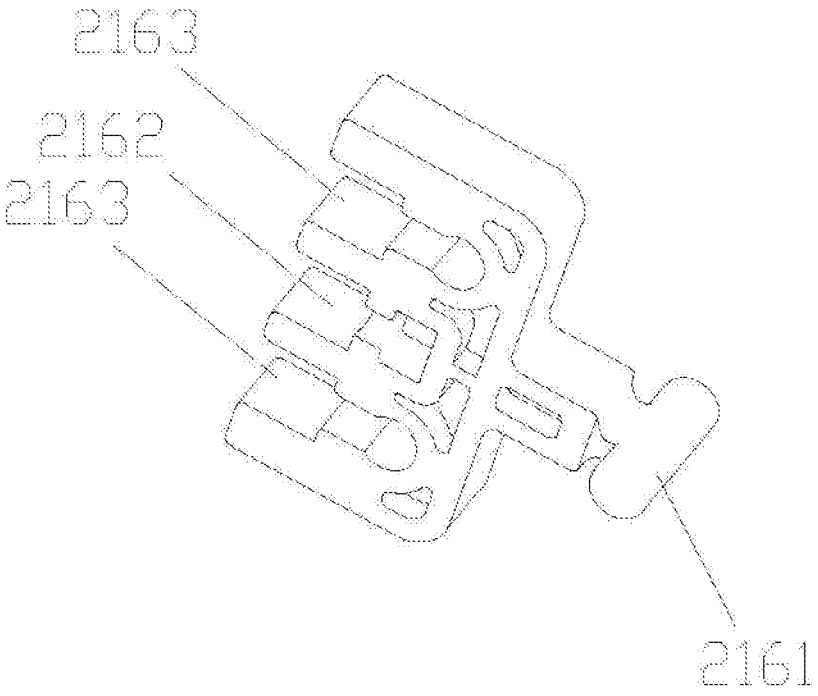
FIG. 7 is a structural diagram of a connection block of the embodiment of the present disclosure.

As shown in FIG. 1 to FIG. 3, a bidirectional damper 2 comprises a bidirectional damping 21, an inner sleeve shell 22, and an inner sleeve 23. A bottom of the inner sleeve shell 22 is fully opening, the bidirectional damping 21 is arranged in the inner sleeve 23, and the inner sleeve 23 is arranged in the inner sleeve shell 22.

A part of a middle section of a top of the inner sleeve 23 has an opening, and a bottom of the inner sleeve 23 is fully opening. Rollers 232 are arranged on two ends of the fully opening of the bottom of the inner sleeve 23. The roller 232 is riveted to the inner sleeve 23 by a riveting column 233

As shown in FIG. 4 to FIG. 7, the bidirectional damping 21 comprises a box body 211, a damping box 212, two damping cylinders 213, a spring assembly, two sliding blocks 215, and a connection block 216. The spring assembly comprises a first spring 214 and a second spring 217. The damping box 212, the two damping cylinders 213, the first spring 214, the second spring 217, the two sliding block 215, and the connection block 216 arranged in the box body 211.

The box body 211 is formed by buckling an upper box cover and a lower box cover. A sliding opening 2111 is arranged on a bottom of the box body 211, and two sliding grooves 2112 are arranged on two sides of the box body 211. Each sliding groove 2112 comprises a horizontal groove distributed along a length direction of the box body 211, and a curve groove extending towards the top of the box body 211. The curve groove is connected with one end that horizontal groove is close to the end of the box body 211.

Two containing grooves for containing the damping cylinders 213 and one containing groove for containing the first spring 214 are arranged on the damping box 212. The first spring 214 and the two damping cylinders 213 on the damping box 212 are arranged in parallel, and the first spring 214 is located between the two damping cylinders 213. The second spring 217 is arranged on one side of the damping box 212 and the second spring and the damping box 212 are arranged in parallel. And two ends of the second spring 217 are connected with the two sliding blocks 215. The two sliding blocks 215 and the second spring 217 are fixed by a clamping hole 2155 arranged on the sliding block 215 and a clamping pin arranged at the end of the second spring 217.

A cylinder body of the damping cylinders 213 and the end of the first spring 214 are fixed in the damping box 212. A top of a piston rod of the cylinder body and the other end of the first spring 214 both have the clamping pin. A clamping hole 2163 corresponding to the clamping pin on the piston rod of the cylinder body and a clamping hole 2162 corresponding to the clamping pin on the end of the first spring 214 are arranged on an end of the connection block 216. The piston rod of the damping cylinders 213 and the first spring 214 arranged on the damping box 212 are fixed by the clamping hole and the clamping pin. Pivots 2161 are arranged on the ends of the damping box 212 and the connection block 216.

One of the two sliding blocks 215 is arranged on the end of the damping box 212, one of the two sliding blocks 215 is arranged on the end of the connection block 216. A pivot hole 2152 is arranged on an end of the two sliding blocks 215 corresponding to the pivot 2161. The damping box 212 is connected with the connection block 216 by connecting the pivot 261 with the pivot hole 2152 of the sliding blocks 215, which makes the damping box 212, the connecting block 216, and the corresponding sliding block 215 swing around the pivot. Sliding pins 2151 are arranged on two opposite sides of the sliding block 215, and the sliding pins 2151 are arranged on the end of the sliding block 215 corresponding to the pivot hole 2152. The sliding pins 2151 are sliding and arranged in the sliding grooves 2112 of the side of the box body 211 to make the sliding blocks 215 slide along sliding grooves 2112.

A first blocking portion 2153 and a second blocking portion 2154 are arranged on a lower end of the sliding block 215. The first blocking portion 2153 is located at an end, close to the sliding pin 2151, of the lower end of the sliding block 215. The second blocking portion 2154 is located at an end, close to the pivot hole 2152, of the lower end of the sliding block 215. The first blocking portion 2153 and the second blocking portion 2154 extend out the box body 211 from the sliding opening 2111 of the box body 211. The sliding pins 2151 of the sliding block 215 moves from the horizontal groove to curve groove. When the sliding pins 2151 of the sliding block 215 move along the curve groove, the sliding block 215 swings around the pivot 2161, so that the second blocking portion 2154 tilts, and the first blocking portion 2153 is contained in the box body 211 in a swinging mode. The sliding block 215 stays at a curve end of the sliding groove 2112 under elasticity of the second spring 217 and a groove wall of the curve groove.

The bidirectional damper 2 is used for bidirectional damping buffer on a movable door. The movable door comprises a door body, the bidirectional damper 2, a track 1, and a collision block 3. The tracks are arranged above and below the door body, respectively. A groove is arranged on a bottom of the door body, and the bidirectional damper 2 is contained and fixed in the groove. The body door can move along the track 1.

Figure 8:
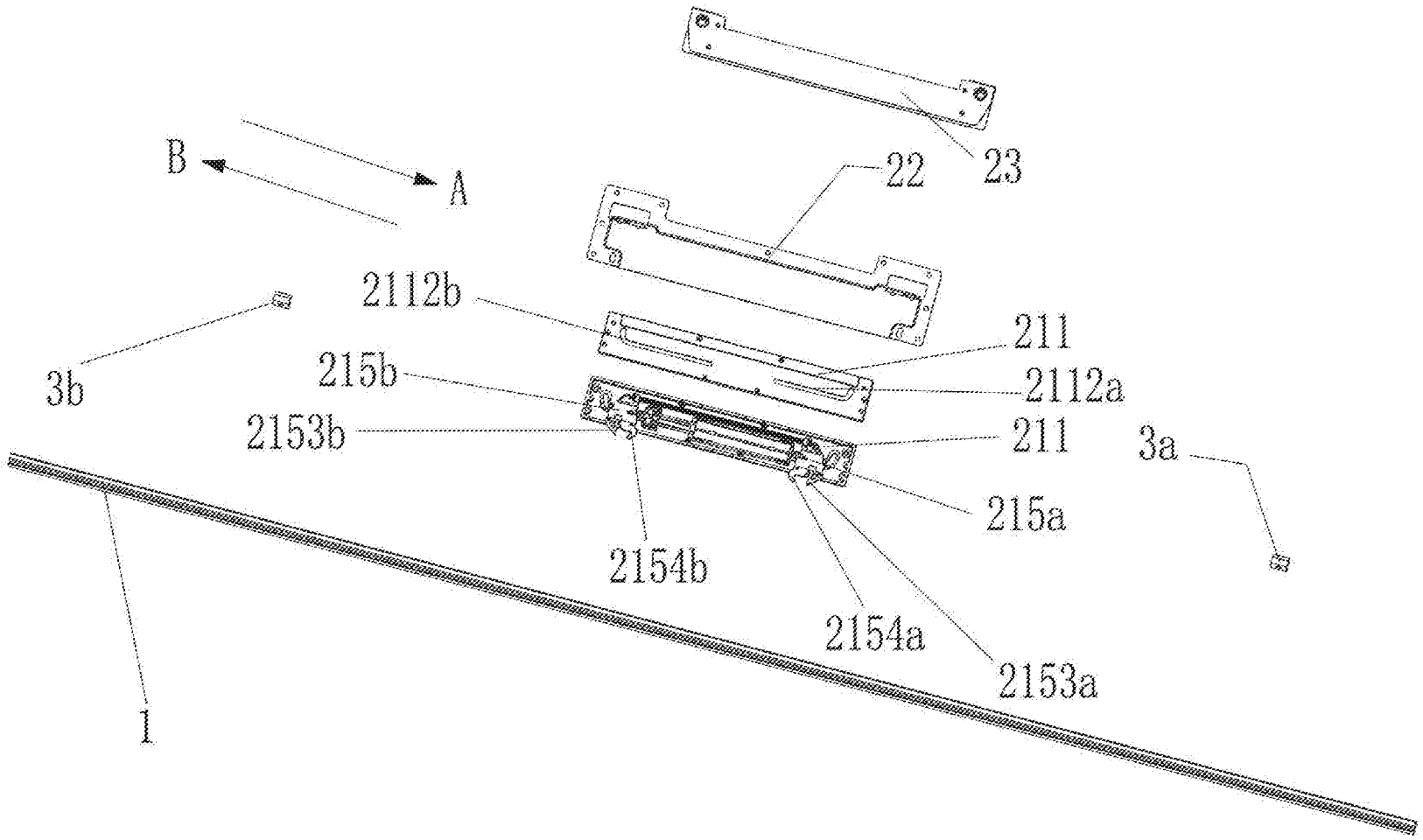
FIG. 8 is a structural diagram of a track and the bidirectional damper of the embodiment of the present disclosure.
Figure 9:
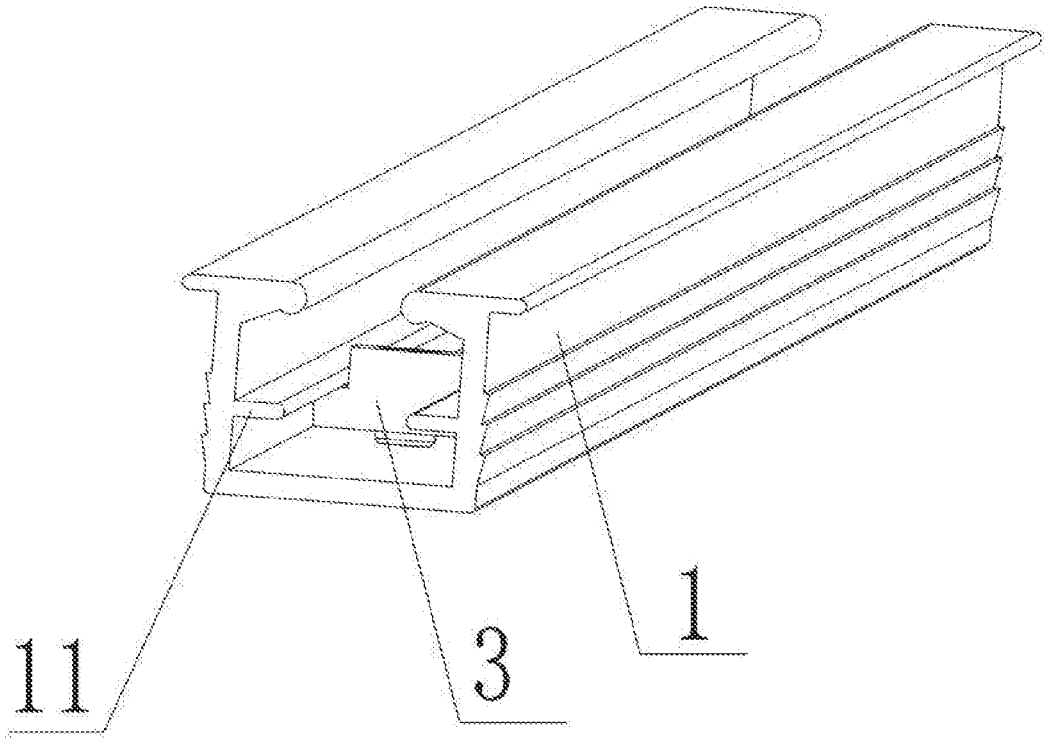
FIG. 9 is a structural diagram of the track of the embodiment of the present disclosure.
Figure 10:
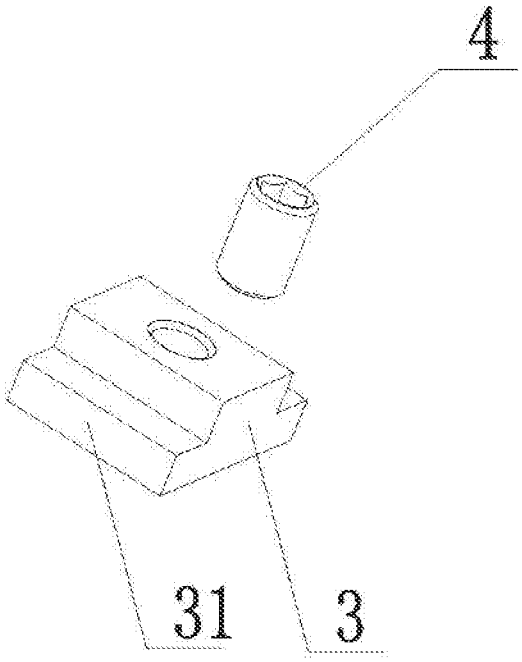
FIG. 10 is an exploded diagram of a collision block and screw of the embodiment of the present disclosure.

As shown in FIG. 8 to FIG. 10, the collision block 3 is located in the track 1 corresponding to installation position of the bidirectional damping 21, and is matched with the bidirectional damping 21. The collision block 3 comprises a first collision block 3*a* and a second collision block 3*b*. Flanges 11 are oppositely arranged on an inner side of the track 1, and extension parts 31 are arranged on the two sides of a bottom of the collision block 3, and the extension parts 31 are located below the flanges 11 in the track. A through screw hole is arranged in a top of the collision block 3, and a screw 4 matched with the through screw hole that abuts against the bottom of the track 1. The screw is adjusted to enable the collision block 3 to rise to the extension parts 31 to be clamped on the flanges 11, and the collision block 3 can be contained in a gap between the first blocking portion 2153 and the second blocking portion 2154.

In order to describe the sliding groove 2112 in using method of the bidirectional damping of the movable door, one end, corresponding to the curve groove, of the sliding groove 2112 is regarded as a curve end, and one end, corresponding to the horizontal groove is regarded as a horizontal end. The sliding block, corresponding to the first collision block 3*a*, is regarded as a first sliding block 215*a*, and the sliding block, corresponding to the second collision block 3*b*, is regarded as a second sliding block 215*b*. The sliding groove, corresponding to the first sliding block 215*a*, is regarded as a first sliding groove 2112*a*, and the sliding groove, corresponding to the second sliding block 215*b*, is regarded as the second sliding groove 2112*b*.

When the door body moves along the track, the first collision block 3*a* in the track can impact the first blocking portion 2153*a* or a second blocking portion 2154 of the sliding block 215*a*. The second collision block 3*b* in the track can impact the first blocking portion 2153*b* or the second blocking portion 2154*b* of the second sliding block 215*b*. When the movable door is in a reciprocating process of opening and closing, the sliding blocks can reciprocate along the corresponding sliding grooves along with the movement of the door body, and the two sliding blocks are located at the curve ends of the corresponding sliding grooves when the movable door is located in the middle section of the track. FIG. 8 shows an initial state, where the sliding pin of the first sliding block 215*a* is located at the curve end of the first sliding groove 2112*a*, and the sliding pin of the second sliding block 215*b* is located at the horizontal end of the second sliding groove 2112*b*. The first collision block 3*a* is fixed on the track 1, and is located at one end, which is far away from the first sliding block 215*a*, of the track 1 (namely one end is close along A-direction). The first blocking portion 2153*a* of the first sliding block 215*a* tilts towards the top of the box body 211 and is stored in the box body, and the second blocking portion is kept extended out in a tilted state. The second collision block 3*b* is fixed to the other end of the track 1 (namely, the other end of the second collision block 3*b* is close along the B-direction) and is located between the first blocking portion 2153*b* and the second blocking portion 2154*b* of the second sliding block 215*b*. The first blocking portion 2153*b* and the second blocking portion 2154*b* of the second sliding block 215*b* extend out the box body 211.

When the movable door is pulled to move along the direction A in the track 1, the second collision block 3*b* hooks on the first blocking portion 2153*b* of the second sliding block 215*b*, and the second sliding block 215*b* is driven to move towards the curve groove and move along the second sliding groove 2112*b* until the sliding pin 2151 of the second sliding block 215*b* enters the curve groove. The second sliding block 215*b* swings along the curve groove, the first blocking portion 2153*b* tilts and contained in the box body 211, so that the second sliding block 215*b* is separated from constraint of the second collision block 3*b* and stays at a terminal end of the curve groove of the second sliding groove 2112*b*. At the moment, the first spring 214 and the second spring 217 are in a stretching state, and the damping cylinders are in an open state (namely, a damping preparation state). The door body can continue to move along the direction A, when the second blocking portion 2154*a* of the first sliding block 215*a* impacts the first collision block 3*a*, the first sliding block 215*a* swings around the pivot 2161, the sliding pin 2151 on the first sliding block 215*a* moves from the curve groove of the first sliding groove 2112*a* to the horizontal groove of the first sliding groove 2112*a*. So that the first blocking portion 2153*a* of the first sliding block 215*a* resets and extends out the box body 211, and the first collision block 3*a* is contained between the first blocking portion 2153*a* and the second blocking portion 2154*a* of the sliding block 215*a*. The first slide block 215*a* continues to move along the horizontal groove until the first slide block 215*a* moves to the terminal under contraction force of the first spring 214 and the second spring 217. At the same time, the damping cylinder cylinders 213 is compressed, and the bidirectional damper 2 is used for damping buffering on the door body, so that the door body moves slowly and stably to the terminal, and the door body completes movement in the direction A.

In the same way, the door body completes movement in the direction A and moves along the direction B. When the movable door is pulled to move along the direction B in the track 1, the first collision block 3*a* hooks on the first blocking portion 2153*a* of the second sliding block 215*a*, and the first sliding block 215*a* is driven to move towards the curve groove and move along the first sliding groove 2112*a* until the sliding pin 2151 of the first sliding block 215*a* enters the curve groove. The first sliding block 215*a* swings along the curve groove, the first blocking portion 2153*a* is warped and contained in the box body 211, so that the first sliding block 215*a* is separated from constraint of the first collision block 3*a*. At the moment, the first spring 214 and the second spring 217 are in a stretching state, and the damping cylinders are in an open state (namely, a damping preparation state). The door body can continue to move along the direction B, when the second blocking portion 2154*b* of the second sliding block 215*b* impacts the second collision block 3*b*, the second sliding block 215*b* swings around the pivot, the sliding pin 2151 on the second sliding block 215*b* moves from the curve groove of the second sliding groove 2112*b* to the horizontal groove of the second sliding groove 2112*b*. So that the first blocking portion 2153*b* of the second sliding block 215*b* resets and extends out the box body 211, and the first collision block 3*a* is contained between the first blocking portion 2153*b* and the second blocking portion 2154*b* of the second sliding block 215*b*. The second slide block 215*b* continues to move along the horizontal groove until the second slide block 215*b* moves to the terminal under contraction force of the first spring 214 and the second spring 217. At the same time, the damping cylinders 213 are compressed, and the bidirectional damper 2 is used for damping buffering on the door body, so that the door body moves slowly and stably to the terminal, and the door body completes movement in the direction B and returns in the initial state.

The bidirectional damper 2 can achieve bidirectional damping buffer and location. The bidirectional damper 2 can be arranged on the bottom of the movable door or top of the movable door, so that structure is simple, installation is convenience and cost is low.

The present disclosure uses specific embodiments to describe the principle and implementation way of the present disclosure. It should be understood, the following description is only a few embodiments, the used directional terms are intended to illustrate, but not to limit, the present invention.

What is claimed is:

1. A bidirectional damper, comprising:

a box body, two damping cylinders arranged in the box body, a spring assembly, and two sliding blocks;

wherein the two damping cylinders and the spring assembly are arranged in parallel between the two sliding blocks; ends of the two damping cylinders and ends of the spring assembly are connected with a corresponding sliding blocks;

wherein sliding pins are arranged on sides of the two sliding blocks, a first blocking portion and a second blocking portion are arranged on lower ends of the two sliding blocks; and wherein sliding grooves are arranged on sides of the box body and extend along two ends of the box body;

the sliding grooves match with the sliding pins on the two sliding blocks; an end of the sliding grooves, near an end of the box body, is bent towards a top of the box body;

a sliding opening is arranged on a bottom of the box body; the first blocking portion and the second blocking portion on lower ends of the two sliding blocks extend out the box body from the sliding opening of the box body;

wherein the spring assembly comprises a first spring and a second spring; the second spring is arranged on one side of a damping box; the second spring and the damping box are arranged in parallel; two ends of the second spring are connected with the two sliding blocks; the first spring is arranged on the damping box;

two containing grooves for containing the two damping cylinders and one containing groove for containing the first spring are arranged on the damping box;

the first spring and the two damping cylinders on the damping box are arranged in parallel, and the first spring is located between the two damping cylinders; the ends of the two damping cylinders and the first spring are correspondingly connected with a connection block; pivots are arranged on ends of the damping box and ends of the connection block; pivot holes are arranged on the two sliding blocks and are matched with the pivots; the two damping cylinders are connected with the first spring by the pivots of the two damping cylinders and the connection block and the pivot holes of the two sliding blocks; the box body is arranged in an inner sleeve, and an opening, corresponding to the sliding opening of the box body is arranged on a bottom of the box body; rollers are arranged on two ends of a bottom of the inner sleeve; a top of the inner sleeve is fixed on an inner sleeve shell.

2. A movable door, comprising: a door body; a bidirectional damper and two collision blocks corresponding to two sliding blocks are arranged on a top or a bottom of the door body; wherein the bidirectional damper comprises:

a box body, two damping cylinders arranged in the box body, a spring assembly, and two sliding blocks;

wherein the two damping cylinders and the spring assembly are arranged in parallel between the two sliding blocks; ends of the two damping cylinders and ends of the spring assembly are connected with a corresponding sliding blocks;

wherein sliding pins are arranged on sides of the two sliding blocks, a first blocking portion and a second blocking portion are arranged on lower ends of the two sliding blocks; and wherein sliding grooves are arranged on sides of the box body and extend along two ends of the box body;

the sliding grooves match with the sliding pins on the two sliding blocks; an end of the sliding grooves, near an end of the box body, is bent towards a top of the box body;

a sliding opening is arranged on a bottom of the box body; the first blocking portion and the second blocking portion on lower ends of the two sliding blocks extend out the box body from the sliding opening of the box body;

wherein the spring assembly comprises a first spring and a second spring; the second spring is arranged on one side of a damping box; the second spring and the damping box are arranged in parallel; two ends of the second spring are connected with the two sliding blocks; the first spring is arranged on the damping box;

two containing grooves for containing the two damping cylinders and one containing groove for containing the first spring are arranged on the damping box; the first spring and the two damping cylinders on the damping box are arranged in parallel, and the first spring is located between the two damping cylinders; the ends of the two damping cylinders and the first spring are correspondingly connected with a connection block; pivots are arranged on ends of the damping box and ends of the connection block; pivot holes are arranged on the two sliding blocks and are matched with the pivots; the two damping cylinders are connected with the first spring by the pivots of the two damping cylinders and the connection block and the pivot holes of the two sliding blocks; the box body is arranged in an inner sleeve, and an opening, corresponding to the sliding opening of the box body is arranged on a bottom of the box body; rollers are arranged on two ends of a bottom of the inner sleeve; a top of the inner sleeve is fixed on an inner sleeve shell;

when the door body moves, the two collision blocks correspondingly impact the first blocking portion or the second blocking portion.

3. The movable door as claimed in claim 2, further comprises a track corresponding to the bidirectional damper; wherein the two collision blocks are arranged in the track, and the movable door move along the track.

4. The movable door as claimed in claim 3, wherein flanges are arranged on an inner side of the track and extension parts are arranged on the two sides of bottoms of the two collision blocks; the extension parts are located below the flanges in the track; through screw holes are arranged in tops of the two collision blocks, and screws matched with the through screw holes are abutted against the bottom of the track; the screws enable the two collision blocks to rise to the extension parts to be clamped on the flanges.

* * * * *